United States Patent [19]

Cigognetti

[11] Patent Number: 4,667,618

[45] Date of Patent: May 26, 1987

[54] REMOVABLE CONNECTION OF A RIGID DECK AND RIGID KEEL TO THE COVERS OF AN INFLATABLE BOAT

[76] Inventor: Edoardo Cigognetti, Via della Repubblica 19, Senago, Milan, Italy

[21] Appl. No.: 771,232

[22] Filed: Aug. 29, 1985

[30] Foreign Application Priority Data

Sep. 18, 1984 [IT] Italy ..... 23187/84[U]

[51] Int. Cl.[4] ..... B63B 7/08

[52] U.S. Cl. ..... 114/345; 114/360

[58] Field of Search ..... 114/345, 355, 356, 360, 114/69, 88

[56] References Cited

U.S. PATENT DOCUMENTS 3,085,262 4/1963 Plemmons ..... 114/355 X
3,577,576 5/1971 Lobb et al. ..... 114/345 X
4,329,751 5/1982 Cigognetti ..... 114/345
4,498,413 2/1985 Cochran ..... 114/345

FOREIGN PATENT DOCUMENTS 1589635 5/1981 United Kingdom ..... 114/345

*Primary Examiner*—Joseph F. Peters, Jr.
*Assistant Examiner*—Paul E. Salmon
*Attorney, Agent, or Firm*—Young & Thompson

[57] ABSTRACT

A device for releasably connecting a rigid deck and a rigid hull to the covers of the bladders of an inflatable boat comprises an assemblage of two rigid plates joined together along their edges to form a sealed chamber which is fastened to the covers of the bladders, or directly to these latter, through bolts acting through the intermediary of suitable pressure elements. Holes passing through the edges of the two rigid plates are provided for the bolts.

2 Claims, 8 Drawing Figures

REMOVABLE CONNECTION OF A RIGID DECK AND RIGID KEEL TO THE COVERS OF AN INFLATABLE BOAT

This present invention pertains to a device adapted to realize a removable connection of a rigid deck as well as of a rigid keel to the covers of the inflatable air chambers of a pneumatic boat.

BACKGROUND OF THE INVENTION

The pneumatic boats of relatively large dimensions, having, for instance, a length of four to eight meters and designed for conveying an appropriate number of people or a suitable quantity of cargo as well as for advancing to a considerable distance from the coast, are mainly provided, notoriously, with a floating body including a certain number of air chambers inflatable by means of compressed air, which are suitably arranged within a protective covering envelope.

So long as the boat length does not exceed three or four meters, the task of playing the double function of "keel" and of "deck" can be entrusted advantageously to one straightening element only, which has to be rigid or opportunely stiffened. If the boat length surpasses these values, the employment of only one straightening element results in some considerable difficulties indeed.

SUMMARY OF THE INVENTION

The aim of the present invention is to realize a deck-keel unit constituted of at least two plate-shaped elements made of a rigid (for instance, metallic) material, which form together a completely sealed chamber provided with at least one salient edge (flange) having a certain width and opportunely inclined and also so formed as to make it possible to lay it along a longitudinal line, with respect to to the covers of the existing air chambers; this same edge being provided with a plurality of piercing holes, evenly distributed, and being able to be fixed to the mentioned covers by means of some bolts acting by the aid of some special pressing elements which can be partially inserted into each other.

BRIEF DESCRIPTION OF THE DRAWINGS

The device constituting the object of this present invention will be now described in more detail for a better understanding referring to the accompanying drawings, which illustrate it in conformity with the preferred and simplest embodiment.

In these drawings.

DETAILED DESCRIPTION OF THE DRAWINGS

Figure 2:
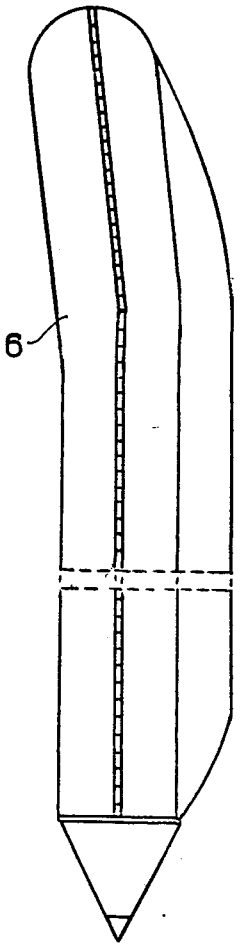
FIGS. 1 and 2 are two views, respectively a top and a side view, of a pneumatic boat conformable to the invention.
Figure 1:
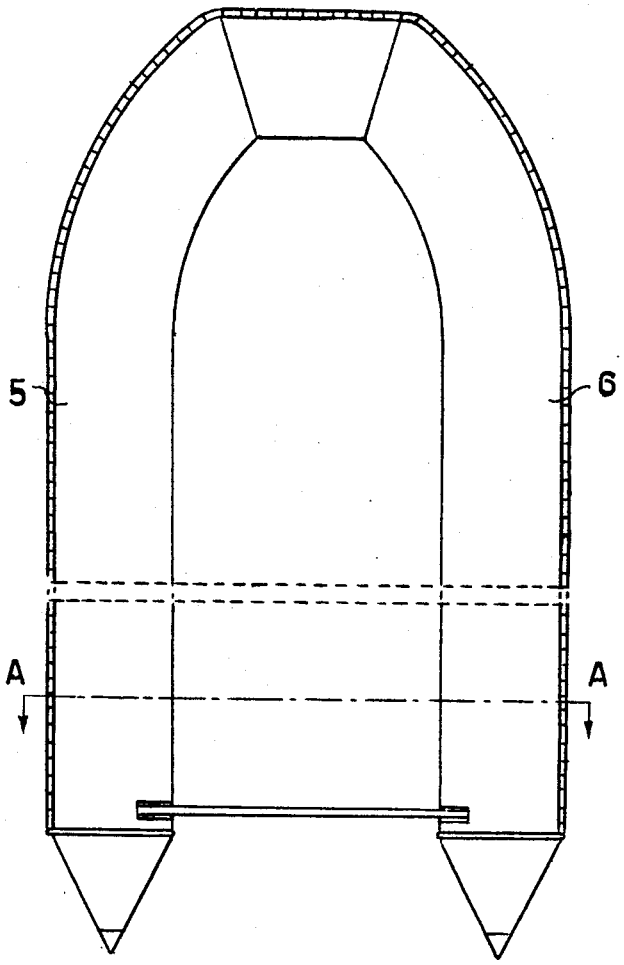
Figure 3:
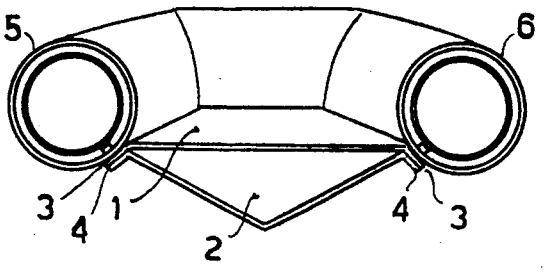
FIG. 3 is a sectional view of the same boat, taken along the line A—A of FIG. 1.
Figure 4:
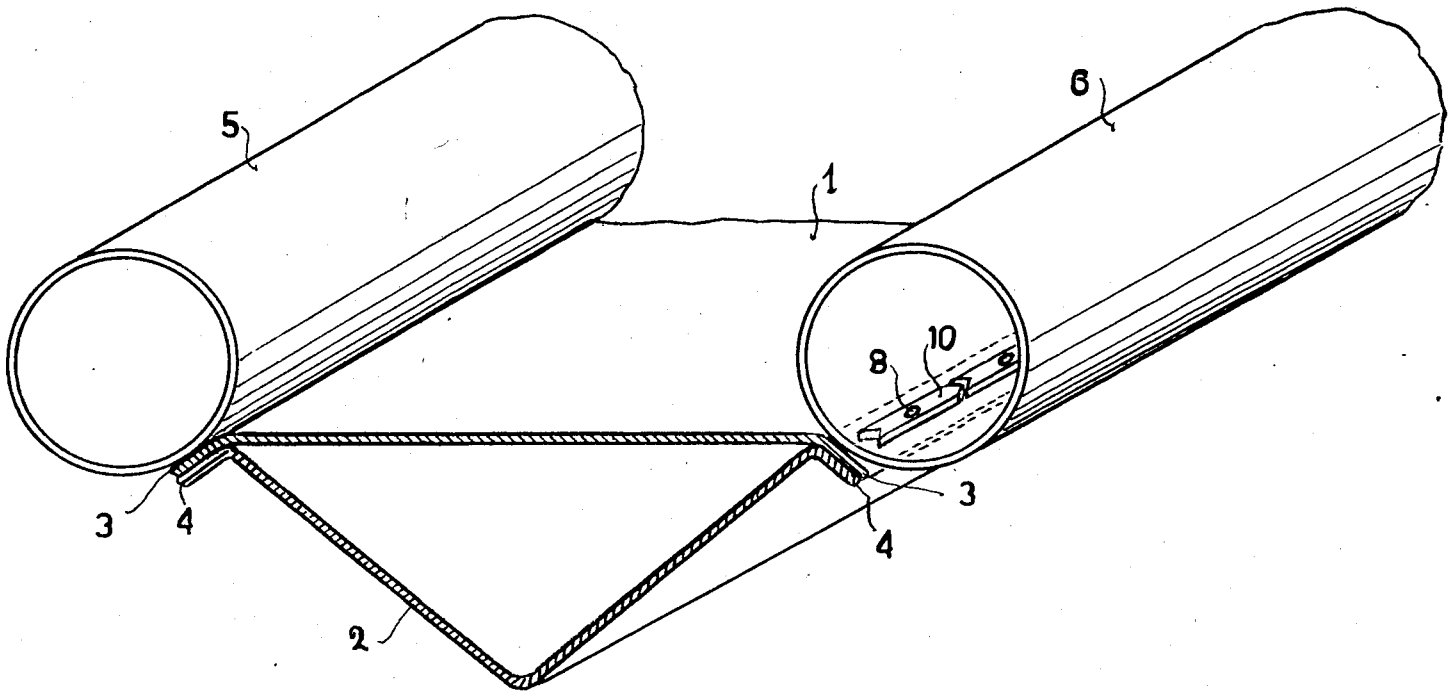
FIG. 4 shows, in larger scale, in part by sectional view and in part according to an axonometric view, two air-chamber covers to which the unit forming the tight chamber is fixed, the inclined edge of which are precisely fixed to the said covers.

The device constituting the object of this present invention includes a unit forming a sealed chamber which is constituted, for instance, and according to the simplest embodiment, by an above-standing, preferably metallic, plate 1, having a substantially rectangular plan and adapted to form the "deck", and by a, likewise preferably metallic, below-standing plate 2, having a substantially rectangular plane, bent in a dihedral angle such that it has a concavity directed toward the above-standing plate 1, and adapted to form the "keel"; these two plates being connected to each other along the edges 3 and 4 (as shown in FIGS. 3, 4) and these foretold edges, which can have a more or less consistent width, being provided with a plurality of evenly distributed piercing holes.

The edges 3,4 are connected to the covers 5,6 by means of bolts, such as 8, the shafts of which cross the walls of the aforesaid covers along longitudinal lines, as shown clearly in FIG. 4. Between every bolt and the material constituting the covers a special pressing element, such as 10, having the task of making the pressure uniform on a relatively deformable surface, is inserted.

Figure 5:
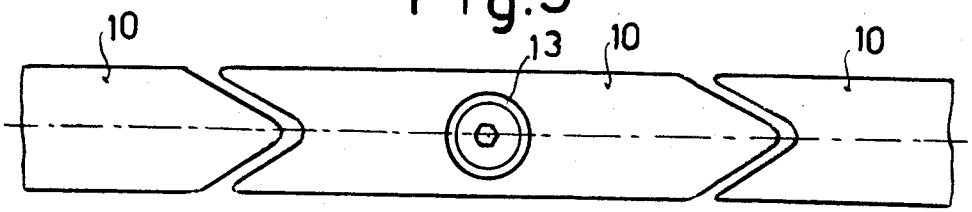
FIGS. 5, 6 and 7 show in three views and in larger scale the pressing elments which allow, by means of appropriate bolts, to press evenly on the covers, so that a tight connection between the same covers and the sealed chamber can be established.
Figure 6:
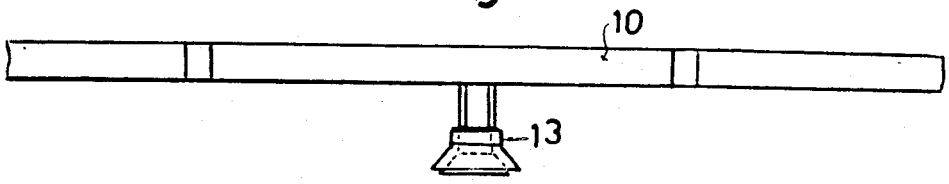
Figure 7:
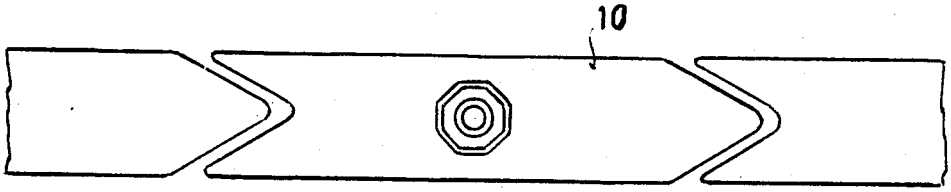

This pressing element 10 is constituted substantially by a rigid little block, which is inscriptible in a lengthened parallelepiped and ends at its two shorter opposite extremities with a V-shaped projection and respectively with a V-shaped groove, which allow each pressing element to be inserted partially into the contiguous one. FIGS. 5, 6 and 7 show the function of the pressing element clearly.

Figure 8:
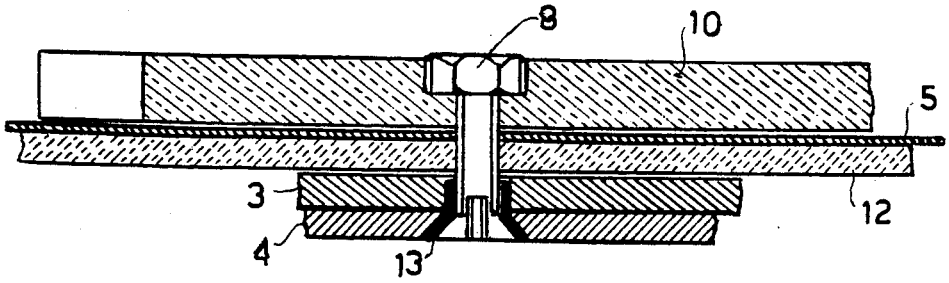
FIG. 8, finally, is a sectional view, in an again larger scale, showing partially the manner whereby, by the employment of a bolt and of a pressing element the connection of a cover with the below-standing sealed chamber is obtained.

Pursuing the aim of assuring a perfect seal between the sealed chamber (1,2) and the covers (5,6) of the air chambers, it has been foreseen to employ a tape-shaped gasket 12 made of elastomer, between the same covers and the edges (3,4) of the foretold sealed chamber, as shown clearly in FIG. 8.

Moreover it has been foreseen to employ a conical gasket 13, preferably made of elastomer as well, in order to make perfect the seal between the head of the bolt 8 and the deck/keel unit (3,4).

It is obvious that the conformation of the element, designed to form the keel of the boat and to be connected to the element designed to constitute the deck of the same, can be realized in a different manner from that which has been described and illustrated here above, that is to say that it could be different from a simple dihedron and that the longitudinal axis of some pressing elements can be, rather than rectilinear, lightly bent, in order allow to these pressing elements to act more efficaciously on the covers following their conformation. This all can be made without going out of the protection boundaries of this patent.

It is obvious too that, in special cases, the sealed chamber, composed of a deck and a keel, can be directly connected to the air chambers inflatable by means of compressed air.

I claim:

1. A device for releasably connecting a rigid deck and a rigid hull to an outer layer of an inflatable boat comprising a sealed chamber composed of a substantially rectangular rigid upper plate having peripheral edges and forming the deck of the inflatable boat, and a bent rigid lower plate having peripheral edges and concave towards said upper plate, forming the hull of the boat, said upper and lower plates each having a plurality of holes passing through their respective peripheral edges, the holes of the upper plate being aligned with corresponding holes of the lower plate; said device comprising a plurality of bolts each passing through said outer layer and an aligned pair of said plurality of holes; and at least one sealing gasket interposed between said outer layer and said upper plate.

2. Device according to claim 1, and pressure elements adapted to be interposed between said outer layer and said plurality of bolts, said pressure elements comprising suitably perforated rigid blocks being inscribable in elongated parallelepipeds and having substantially straight axes, each of which blocks comprises opposite ends in the form of a V-shaped projection and a reversed-V-shaped groove respectively, thereby permitting each pressure element to be partially inserted in the adjoining pressure element in order to equalize the pressure applied by the bolts over a relatively large surface of said outer layer.

* * * * *